US005727752A

United States Patent [19]

Matsuzoe

[11] Patent Number: 5,727,752

[45] Date of Patent: Mar. 17, 1998

[54] REEL FOR TRANSPORTING ELONGATE ARTICLES

[75] Inventor: Noriho Matsuzoe, Hyogo, Japan

[73] Assignee: Gold Industries Co., Ltd., Osaka, Japan

[21] Appl. No.: 764,412

[22] Filed: Dec. 11, 1996

[30] Foreign Application Priority Data

Dec. 18, 1995 [JP] Japan ..... 7-348601

[51] Int. Cl.[6] ..... B65H 75/22

[52] U.S. Cl. ..... 242/608.6; 242/609.1

[58] Field of Search ..... 242/600, 607, 242/608, 608.5, 608.6, 609, 609.1, 610.6, 611.2, 118.4, 118.6

[56] References Cited

U.S. PATENT DOCUMENTS

| | | | |
|---|---|---|---|
| 3,468,492 | 9/1969 | Cragg | 242/608.5 |
| 3,785,584 | 1/1974 | Crellin, Jr. | 242/118.6 |
| 4,473,194 | 9/1984 | Kashimura | 242/608.6 |
| 4,726,538 | 2/1988 | Kovacik et al. | 242/608.6 |
| 5,031,854 | 7/1991 | Loewe | 242/608 |
| 5,114,089 | 5/1992 | Posso | 242/608.6 |
| 5,531,399 | 7/1996 | Weisburn et al. | 242/608.6 |
| 5,575,437 | 11/1996 | Campbell | 242/609.1 |

FOREIGN PATENT DOCUMENTS

| | | | |
|---|---|---|---|
| 2-193380 | 7/1990 | Japan | 242/608.5 |

*Primary Examiner*—John P. Darling
*Attorney, Agent, or Firm*—Edwin E. Greigg; Ronald E. Greigg

[57] ABSTRACT

A reel for transporting elongate articles has a pair of substantially flat and round discs, and a hub of a cylindrical shape and interposed between the discs to connect them one to another. Hooks each having a hooking head and a body are secured to an inner periphery of the hub. One or more resilient pawls are provided for each disc, the pawl having a locking end and a body also secured to the inner periphery. The hooking heads are bent perpendicular to the respective bodies, facing in the same circular direction and protruding from open ends of the hub beyond an outer face of each disc. The locking end of the pawl is elastically and temporarily displaceable in an axial direction of the hub. Slots are formed in each disc for engagement with the respective the hooking heads. At least one aperture is also formed in each disc for engagement with the locking ends of the resilient pawls, such that the reel can be assembled and disassembled easily and readily to make it possible to pack the reels compact in a cargo when they have been emptied.

3 Claims, 6 Drawing Sheets

REEL FOR TRANSPORTING ELONGATE ARTICLES

BACKGROUND OF THE INVENTION

1. Field of the Invention

The present invention relates to a reel for transporting elongate articles, wherein the reel is composed of a pair of discs connected one to another by a middle hub. The elongate articles such as flexible tapes, wires and chains will be wound up on the hub so as to be transported to a site where they are used. At the site, an axle will be inserted in a central bore of the hub so that the reel rotates to unwind the article therefrom.

2. Description of the Prior Art

The reels of this kind have widely been used to wind up thereon and unwind therefrom the elongate articles used in the industries. The size of and distance between each pair of the discs as well as the diameter of the hubs connecting them should match the varied dimension of those articles. Usually, empty reels from which the articles have been unwound are collected at the site and returned to the suppliers for the purpose of reuse.

Although not only the reels once used but also new ones delivered from a reel maker are empty, they have occupied within a cargo the same large space as they were loaded with the articles. Therefore, some proposals were made to enable the empty or new reels to be disassembled and reassembled to be shipped in sections so as to reduce the space which the empty reels will occupy.

Such a collapsible reel of one type currently available is illustrated in FIG. 7. It comprises a plurality of arrow-shaped lugs 8A protruding from the end surfaces of a hub 3A. Small apertures 10A that are formed in discs 2A will engage with the lugs, forcing the long body portions thereof to temporarily rock against their resiliency in a manner shown at the phantom lines 'c'. This structure relies only on the elastic recovery of said portions to keep the lugs engaged with the apertures. Those lugs have to be rocked again when it is desired to disengage the discs from the hub of an emptied reel. Further, such resilient lugs 8A should act on the discs 2A so as to inhibit the latter from rotating relative to the hub 3A while the reel is operating. Thus, the effect of elastic recovery will early become weaker due to the mechanical fatigue of said lugs. As a consequence, the assembled state of the reel is rendered less firm and less reliable, thereby disabling the repeated reuse of such a reel.

SUMMARY OF THE INVENTION

An object of the present invention made in view of the described problems is therefore to provide a reel for transporting elongate articles and of such a novel structure that it can be repeatedly assembled and disassembled easily and readily, without rendering less reliable the engagement of its discs with its hub.

The reel provided herein for transporting elongate articles comprises a pair of substantially flat and round discs, a hub of a cylindrical shape and interposed between the discs to connect them one to another, hooks each having a hooking head and a body secured to an inner periphery of the hub, at least one resilient pawl for each disc, the pawl having a locking end and a body secured to the inner periphery, the hooking heads bent perpendicular to the respective bodies, arranged in the same circular direction and protruding from open ends of the hub beyond an outer face of each disc, the locking end of the pawl being elastically and temporarily displaceable in an axial direction of the hub, slots formed in each disc so as to engage with the respective ends of the hooks, and at least one aperture also formed in each disc and capable of engaging with the locking end of the resilient pawl.

The bodies of the hooks as well as the body of the pawl may preferably be formed integral with the inner periphery of an external cylinder of the hub.

It is also desirable that the hub is composed of the external cylinder and an internal cylinder extending coaxially therewith around an axial bore formed through the internal cylinder, and a tie plate connecting these cylinders one to another. Such a hub as well as the discs may be formed by the molding of a synthetic resin or synthetic resins.

DETAILED DESCRIPTION OF THE PREFERRED EMBODIMENTS

Figure 1:
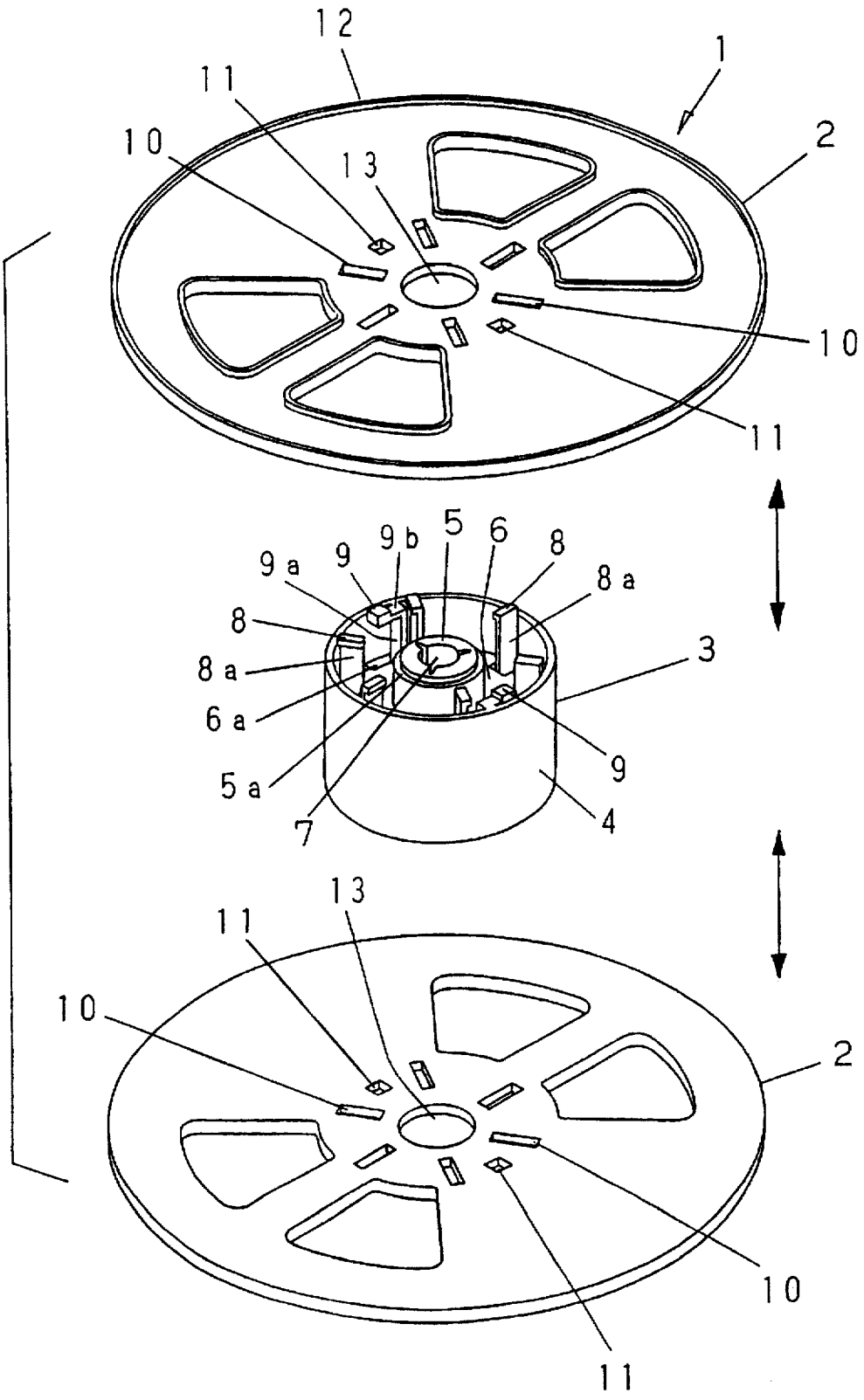
FIG. 1 is a perspective view of a reel provided in a first embodiment and shown in a disassembled state.

A reel provided in embodiments of the present invention described below referring to the drawings is not intended for use with such as the fishing lines or textile yarns but for use with other industrial elongate articles. The reel 1 comprises a pair of discs 2 facing one another and connected by a hub 3 that serves as a core for winding up an elongate article.

Figure 2:
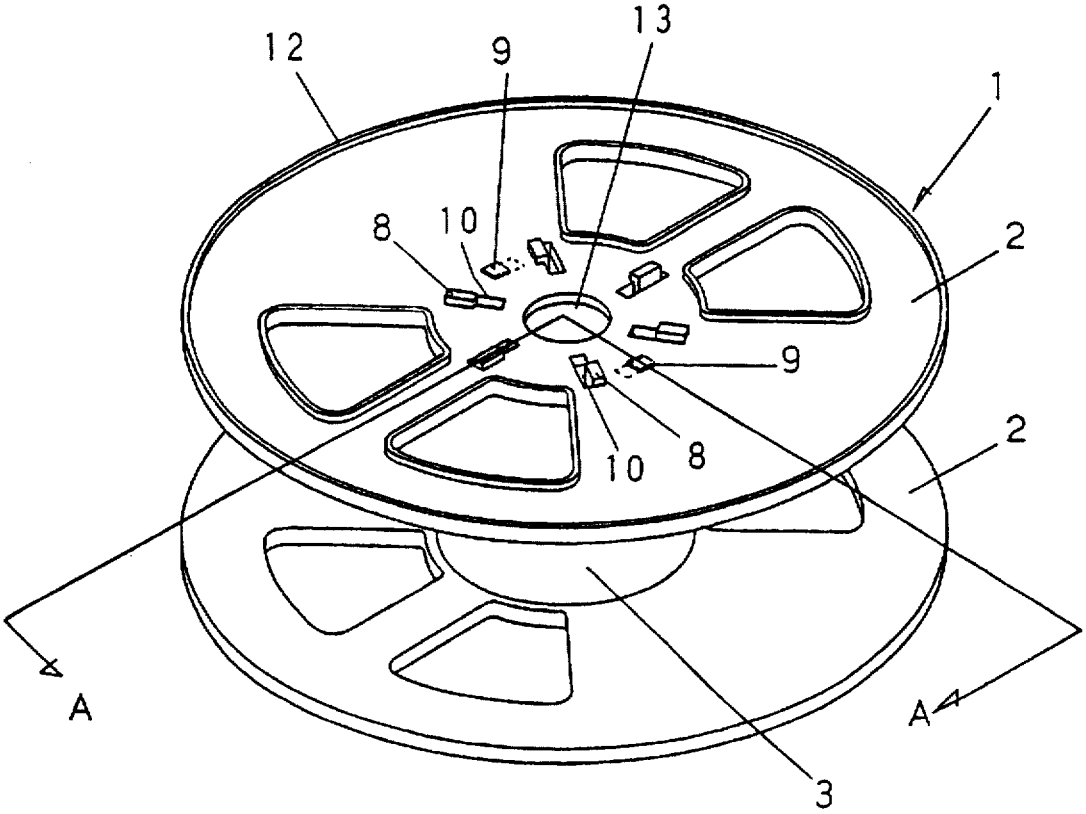
FIG. 2 is a perspective view of the reel shown in its assembled state.
Figure 3:
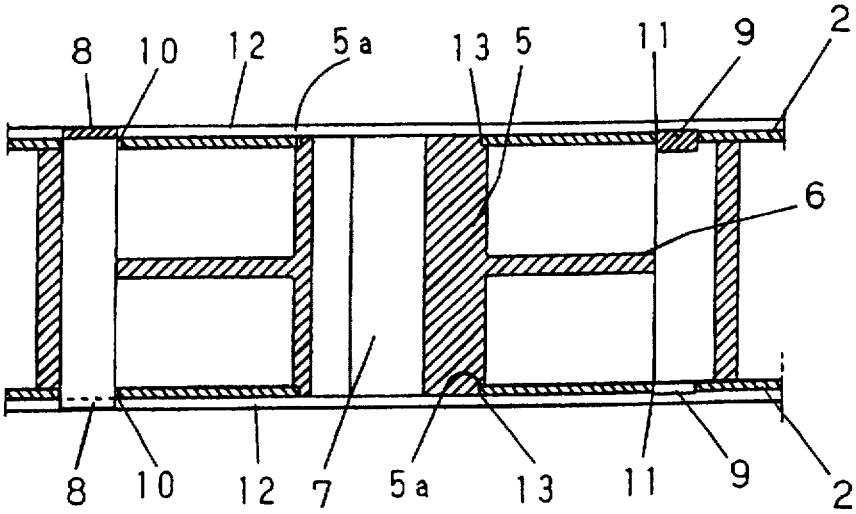
FIG. 3 is an enlarged cross section taken along the line A—A in FIG. 2.

In a first embodiment shown in FIGS. 1 to 3, the hub 3 is interposed between the flat and round discs 2.

The hub 3 consists of an external cylinder 4, an internal cylinder 5 and a tie plate 6. This plate 6 firmly connects the external cylinder 4 to the internal one 5. An axial bore 7 extends through and axially of the internal cylinder. The hub 3 has six hooks 8 and two resilient pawls 9 for each disc, wherein the hooks protrude upwardly and downwardly (in the drawings) from opposite open ends of the hub. Each hook 8 has a body 8*a* that extends inwardly from a hooking head and is integral with the inner periphery of the outer cylinder 4 and the tie plate 6. Similarly, each resilient pawl 9 has a body 9*a* that extends inwardly from a locking end of said pawl and also is integral with said periphery and said plate. Thus, the hooks 8 and the pawls 9 are firmly held at their axially extending bodies in place in the hub 3. The hooking heads of the hooks 8 are bent to be perpendicular to the respective bodies 8*a* and in the same circular direction. The locking end of each of the pawls 9 arranged in the same circular direction has a stepped thin region 9*b* transferring to the body 9*a*, such that said end as a whole extends perpendicular to said body. Thus, the resilient pawls can rock up and down (in the drawings) due to the elastic and temporary movement of those thin regions 9*b*.

Figure 4:
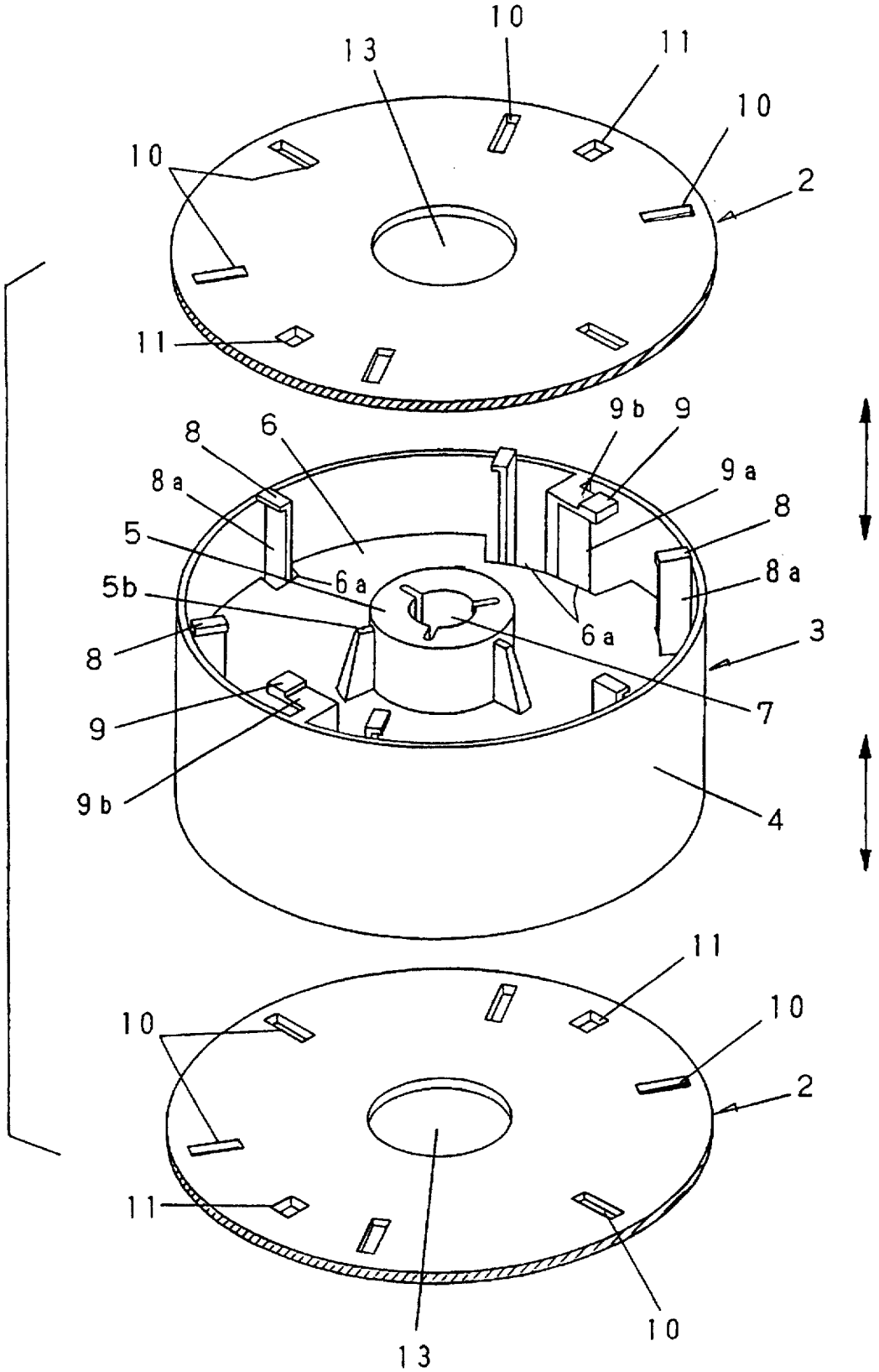
FIG. 4 is a perspective view of another reel disassembled in a second embodiment, with some parts being shown fragmentarily.

Each disc 2 has a central opening 13 in alignment with the axial bore 7 of the hub. An outer peripheral edge of the disc is reinforced with a circular rib 12. Slots 10 formed in each disc are intended to engage with the respective heads of the hooks 8, and apertures 11 also formed in each disc are intended to engage with the locking ends of the resilient pawls 9. The reference numeral 6*a* (as best seen in FIG. 4) denotes cutouts which the tie plate 6 has for the convenience of a mold forming those hooks 8 and pawls 9.

The size of this collapsible reel 1 depends on the length of elongate article to be wound up. Typically, the discs 2 may be 300–600 mm in diameter and 3–10 mm in thickness. The hub 3 may be 100–250 mm in diameter and 40–180 mm in width.

When assembling the reel, the hooking heads of the hooks 8 protruding upwardly and downwardly (in the drawings) will be inserted in the slots 10 at first. Subsequently the upper one of the discs 2 will be twisted clockwise a small angle (with the lower one twisted anti-clockwise). Consequently, a free edge of the hook's head 8 will be brought into engagement with a radial edge of the corresponding slot 10, with the elastic thin region **9*b* of the pawl simultaneously causing its locking end 9 to snap into the aperture 11. As a result, the discs 2 are secured to the hub 3 to provide an assembled reel shown in FIG. 2. The heads of the hooks 8 as well as the ends of the pawls 9 do not protrude beyond a plane in which the annular rib 12 is included, so that the reels can be stacked snugly one on another. The reference numeral 5*a* in FIGS. 1 and 3 denotes an annular shoulder formed around an end face of the internal cylinder 5. The periphery defining the central opening will fit on this shoulder so as to protect the disc 2 from moving radially relative to the hub 3**.

The reel assembled in the described manner is ready for an elongate article to be wound up, if the former matches to the latter. If they do not match one to another, any of discs of different diameters may be combined with any of hubs of different widths. The reel from which the article has been unwound completely will be disassembled into sections. For this purpose, a pointed tool such as a driver may be used to push and force the pawls 9 out of engagement with the apertures 11 while the upper disc 2 is being twisted counterclockwise. The reels collapsed in this manner can be packed compact for return to a winding site.

FIG. 4 shows on an enlarged scale a reel in a second embodiment. The thinned regions **9*b* of the resilient pawls 9 extend in a circular direction opposite to that in which the hooking heads 8 extend from the hook bodies. The numeral 5*b*** denotes axial ribs for supporting the central portion of each disc.

Figure 5:
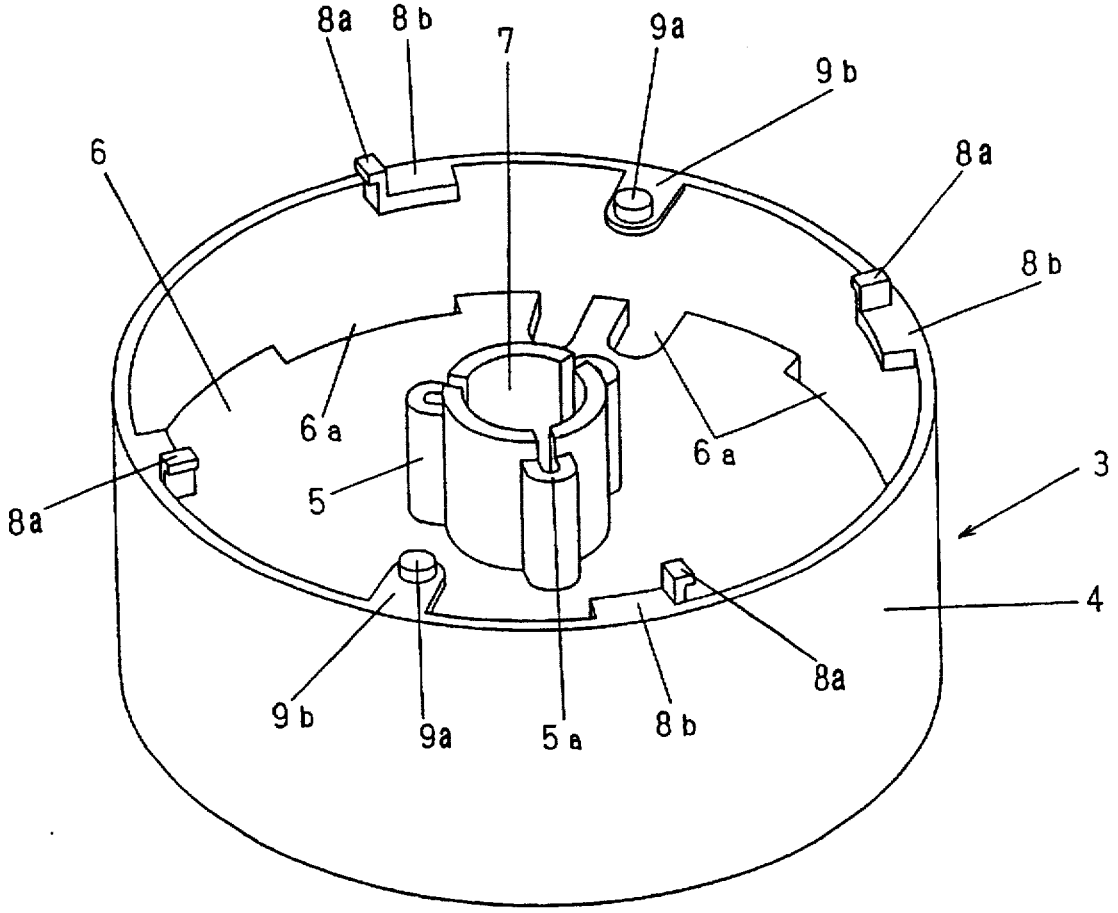
FIG. 5 is a perspective view of a hub included in a further reel that is provided in a third embodiment.

FIG. 5 shows a third embodiment in which the bodies **8*a* and 9*a* of the pawls are of shapes differing from those which the hooks 8 and pawls 9 in the first and second embodiments have. These bodies protrude radially and inwardly from the inner peripheral edge of the external cylinder 4. Further, the locking heads of the pawls 9 are short columns, and internal cylinder 5 is accompanied by three outer axial ridges. The number of the hooks 8** is not six but four for each disc in this case.

Figure 6:
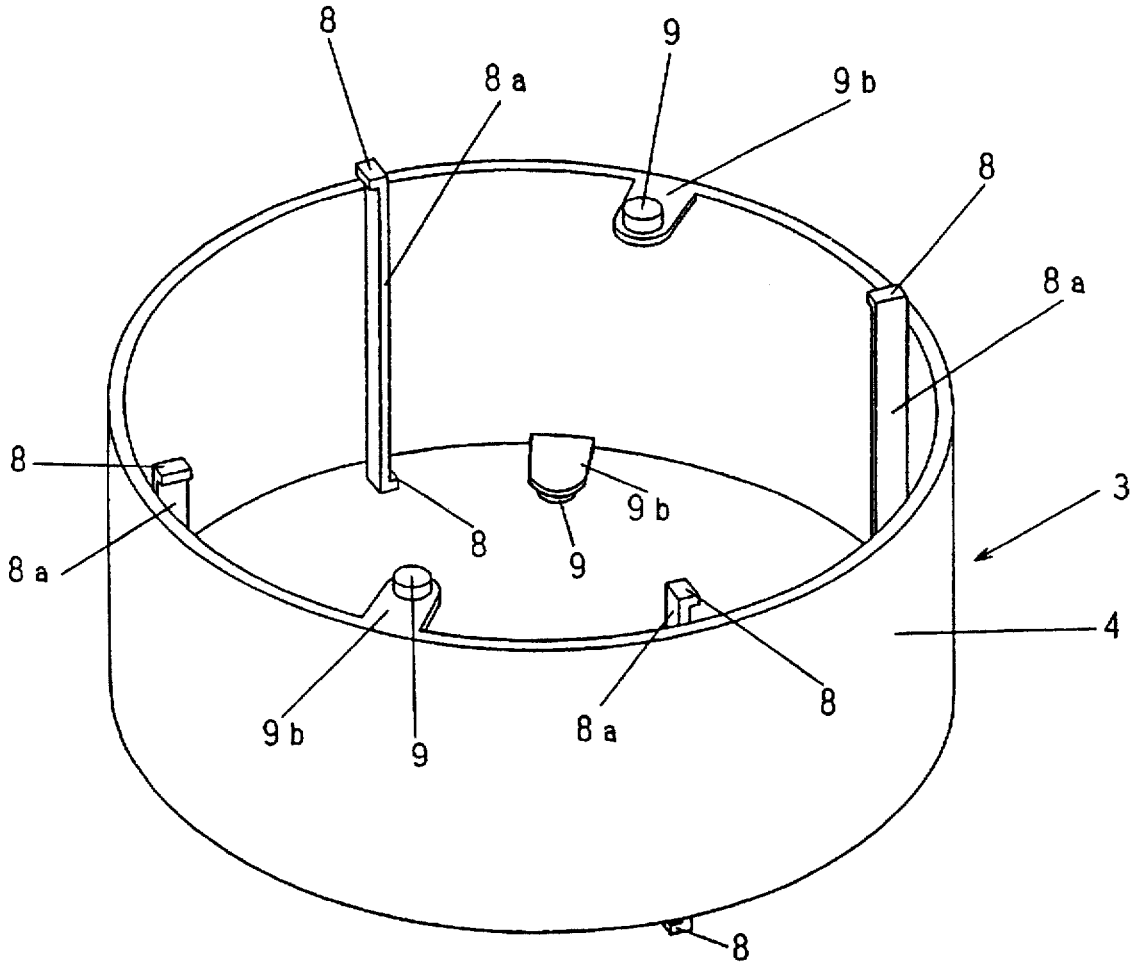
FIG. 6 similarly is a perspective view of a hub included in a still further reel that is provided in a fourth embodiment.
Figure 7:
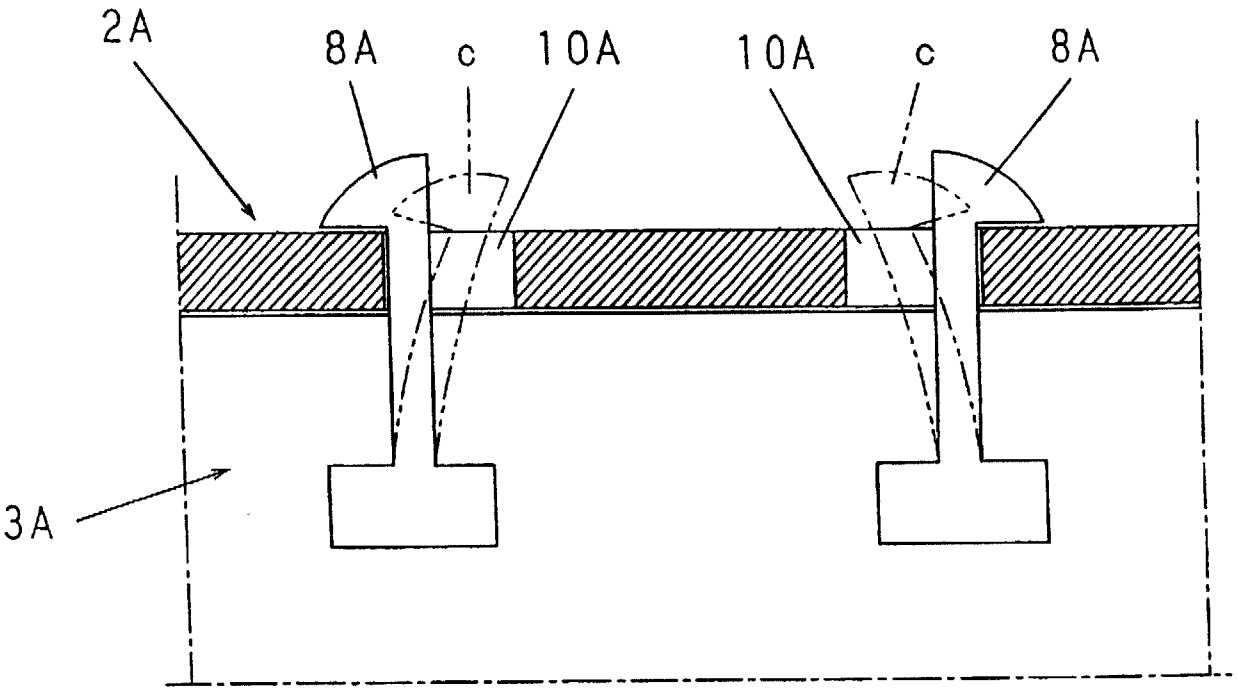
Fig. 7 PRIOR ART
FIG. 7 is a fragmentary and cross-sectional view of a prior art reel.

FIG. 6 shows a fourth embodiment in which the hub 3 consists of only one cylinder 4 that corresponds to the external one in the preceding embodiments. In other words, the internal cylinder 5 and tie plate 6 are dispensed with. The central opening 13 formed in the discs 2 serves as an axial bore of this reel. Further, these discs may not have any central openings under certain circumstances in use. A pair of hooking heads 8 located up and down (in the drawings) are integral with one body **8*a* that in turn is integral with the inner periphery of the hub 3**.

It will be understood that only one pawl 9 in addition to two hooks 8 suffice well for each disc in order to temporarily secure same on the hub.

The foregoing embodiments may be modified in any manner insofar as the functions of the parts as well as the effects of the overall structure are ensured to achieve the objects also set forth above.

In summary, two discs and one hub all prepared separately can now be united by the connecting mechanism to form a durable and stable reel that can be readily disassembled on demand. The hooks as the members formed in the hub to constitute said mechanism have their heads protruding a small distance sideways from the ends of hub, and at least one pawl also formed in the hub to serve as the other connecting member is capable of rocking a small distance merely in an axial direction with respect to the hub. Those hooks engaging with the slots formed in the discs are effective to protect the discs from a high outward pressure which the elongate wound up on the hub will impart to said discs. On the other hand, the pawls engaging with the apertures formed in the discs do protect the discs from an angular displacement around the hub, since the direction in which the pawls can elastically move is perpendicular to a direction in which the discs tend to rotate. This feature that the hooks and the pawls play their own roles different in nature from each other and the directions just mentioned above are perpendicular to each other, is advantageous in that these members will not become fatigued so early even if the operations of assembling and disassembling this reel would be repeated many times, thus remarkably improving the durability thereof.

This collapsible reel can readily be modified in its distance between the discs and in its effective diameter, by selecting discs of a desired diameter and combining them with a hub of an appropriate diameter and proper width. Molds for forming the discs having the slots and apertures and for forming the hub having the hooks and pawls can be comparatively simple in structure, so that the reels of the present invention can be manufactured easily and efficiently.

What is claimed is:

1. A reel for transporting elongate articles comprising:

a pair of substantially flat and round discs;

a hub of a cylindrical shape and interposed between the discs to connect them one to another;

hooks each having a hooking head and a body secured to an inner periphery of the hub;

at least one resilient pawl for each disc, the pawl having a locking end and a body secured to the inner periphery;

the hooking heads bent perpendicular to the respective bodies, facing in the same circular direction and protruding from open ends of the hub beyond an outer face of each disc;

the locking end of the pawl being elastically and temporarily displaceable in an axial direction of the hub;

slots formed in each disc so as to engage with the respective ends of the hooks; and at least one aperture also formed in each disc and capable of engaging with the locking end of the resilient pawl.

2. A reel as defined in claim 1, wherein the bodies of the hooks as well as the body of the pawl are formed integral with the inner periphery of the hub.

3. A reel as defined in claim 2, wherein the hub is composed of an external cylinder and an internal cylinder extending coaxially therewith around an axial bore formed through the internal cylinder, with a tie plate connecting said external and internal cylinders one to another, and the hub as well as the discs are formed by a molding of a synthetic resin or synthetic resins.

* * * * *